US011521567B2

(12) United States Patent
Wu et al.

(10) Patent No.: US 11,521,567 B2
(45) Date of Patent: Dec. 6, 2022

(54) DISPLAY DEVICE SUPPORTING LOCAL DIMMING AND MOTION BLUR REDUCTION

(71) Applicant: REALTEK SEMICONDUCTOR CORPORATION, Hsinchu (TW)

(72) Inventors: Cian-Rou Wu, Hsinchu (TW); Cheng Yueh Chen, Hsinchu (TW); Cheng-Chun Wang, Hsinchu (TW); Li-Ang Chen, Hsinchu (TW); Yung-Chih Chen, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/468,930

(22) Filed: Sep. 8, 2021

(65) Prior Publication Data

US 2022/0335909 A1 Oct. 20, 2022

(30) Foreign Application Priority Data

Apr. 14, 2021 (TW) ..... 110113450

(51) Int. Cl.
*G09G 3/36* (2006.01)
*G09G 3/34* (2006.01)

(52) U.S. Cl.
CPC ..... *G09G 3/36* (2013.01); *G09G 3/3426* (2013.01); *G09G 2310/06* (2013.01);
(Continued)

(58) Field of Classification Search
CPC .. G09G 3/2011; G09G 3/2014; G09G 3/2092; G09G 3/2096; G09G 3/22;
(Continued)

(56) References Cited

U.S. PATENT DOCUMENTS

2012/0169949 A1* 7/2012 Son ..... G02B 6/0056 349/15
2013/0002529 A1* 1/2013 Onogi ..... G09G 3/36 345/102

(Continued)

FOREIGN PATENT DOCUMENTS

TW 201121337 A1 6/2011
TW I431597 B 3/2014

(Continued)

OTHER PUBLICATIONS

"Combining variable refresh rate and strobed backlight", Display-Corner, published 2019, retrieved from the internet <https://display-corner.epfl.ch/index.php/Combining_variable_refresh_rate_and_strobed_backlight> (Year: 2019).*

(Continued)

*Primary Examiner* — Keith L Crawley
(74) *Attorney, Agent, or Firm* — WPAT, P.C., Intellectual Property Attorneys; Anthony King

(57) ABSTRACT

A display device includes a liquid crystal display panel, a backlight module, a control circuit, a driving module, and a waveform generator. The liquid crystal display panel includes a plurality of liquid crystal pixels. The backlight module generates the backlight required by the liquid crystal display panel, and the backlight module includes a plurality of backlight blocks. The control circuit determines a backlight intensity corresponding to each backlight block in a frame period according to an input display data and generates a control signal according to the backlight intensities corresponding to the backlight blocks. The driving module generates a plurality of driving signals to the backlight module in the frame period according to the control signal. The waveform generator generates a de-blur pulse signal to the backlight module. When the de-blur pulse signal is at a (Continued)

high voltage, the backlight blocks emit lights according to the driving signals.

20 Claims, 4 Drawing Sheets

(52) U.S. Cl.
CPC . *G09G 2310/08* (2013.01); *G09G 2320/0261* (2013.01); *G09G 2320/064* (2013.01); *G09G 2320/0686* (2013.01)

(58) Field of Classification Search
CPC ..... G09G 3/34; G09G 3/3406; G09G 3/342; G09G 3/3426; G09G 3/36; G09G 3/3611; G09G 3/3648; G09G 3/3666; G09G 2310/0237; G09G 2310/06; G09G 2310/08; G09G 2320/0261; G09G 2320/062; G09G 2320/0626; G09G 2320/0633; G09G 2320/064; G09G 2320/0646; G09G 2320/0653; G09G 2320/0686; G02F 1/1336; G02F 1/133601; G02F 1/133602; G02F 1/133612
See application file for complete search history.

(56) References Cited

U.S. PATENT DOCUMENTS

| | | | | |
|---|---|---|---|---|
| 2015/0109286 | A1* | 4/2015 | Verbeure | G09G 3/36 345/419 |
| 2017/0018232 | A1* | 1/2017 | Nicholson | G09G 3/2018 |
| 2019/0164506 | A1* | 5/2019 | Wu | G02F 1/133602 |
| 2019/0244572 | A1* | 8/2019 | Le | G09G 3/342 |

FOREIGN PATENT DOCUMENTS

| | | | |
|---|---|---|---|
| TW | I629679 | B | 7/2018 |
| TW | 202018690 | A | 5/2020 |
| TW | I727593 | B | 5/2021 |

OTHER PUBLICATIONS

"Creating a Strobe Backlight", Rejhon, published 2013, retrieved from the internet < https://blurbusters.com/faq/creating-strobe-backlight> (Year: 2013).*

* cited by examiner

DISPLAY DEVICE SUPPORTING LOCAL DIMMING AND MOTION BLUR REDUCTION

CROSS-REFERENCE TO RELATED APPLICATIONS

This application claims priority of Taiwan application No. 110113450, filed on Apr. 14, 2021, which is incorporated by reference in its entirety.

TECHNICAL FIELD

The present application relates to a display device, in particular, to a display device supporting local dimming and motion blur reduction.

BACKGROUND

Liquid crystal (LC) display panels are common display panels nowadays. A liquid crystal display panel includes liquid crystal pixels arranged in an array. Liquid crystals have unique optoelectronic properties, and hence, it is possible to change an arrangement orientation of liquid crystals in a liquid crystal pixel by applying a voltage to the liquid crystal pixel so as to control the light transmittance of the liquid crystal pixel. In other words, the display device can adjust the transmittance of the liquid crystal pixels according to the display data and adjust the intensity of the backlight module so that each liquid crystal pixel can present the desired intensity.

When the human eye tracks the movement of an object in the screen, the human brain expects to see the object at a certain position where the object may appear according to the speed of the object's movement. However, the response time required to change the transmittance of the LCD is longer, so the motion blur is often caused as a result of the difference between the human brain's expected position of the object and the displayed position of the object on the screen when the LCD panel presents a moving object. In order to reduce the issue of motion blur, the prior art often uses a method of inserting a black frame to prevent the human eye from seeing the position of the object in the image that is different from the expected position of the human brain. In addition, in order to save power consumption of the LCD panel, the prior art also has a more delicate operation on the backlight module's light emitting method. In such case, in order to meet various requirements of the system, the LCD panel needs to give multiple sets of commands to the backlight module's driving circuit in each frame time. Furthermore, in order to avoid abnormality in the displayed image, the execution time of each set of commands must be coordinated with each other, resulting in a very complex operation sequence for the driving circuit, and even instability of the system. Therefore, how to effectively control the driving circuit and the backlight module has become a problem to be solved in this field.

SUMMARY OF THE INVENTION

One aspect of the present disclosure provides a display device. The display device includes a liquid crystal panel, a backlight module, a control circuit, a driving circuit, and a waveform generator. The liquid crystal display panel comprises a plurality of liquid crystal pixels. The backlight module generates backlight required by the liquid crystal display panel, wherein the backlight module comprises a plurality of backlight blocks. The control circuit determines a backlight intensity corresponding to each backlight block of the plurality of backlight blocks in a frame period according to an input display data, and generates a control signal according to a plurality of backlight intensities corresponding to the plurality of backlight blocks. The driving circuit generates a plurality of driving signals to the backlight module in the frame period according to the control signal. The waveform generator generates a de-blur pulse signal to the backlight module in the frame period. The plurality of backlight blocks in the backlight module emit lights according to the plurality of driving signals when the de-blur pulse signal is at a high voltage.

Another aspect of the present disclosure provides display method. The display method includes determining a backlight intensity corresponding to each backlight block of a plurality of backlight blocks of a backlight module in a frame period according to an input display data, generating a control signal according to a plurality of backlight intensities corresponding to the plurality of backlight blocks, using a driving circuit to generate a plurality of driving signals to the backlight module in the frame period according to the control signal, using a waveform generator to generate a de-blur pulse signal to the backlight module in the frame period, using the backlight module to generate a backlight required by a liquid crystal display panel according to the plurality of driving signals when the de-blur pulse signal is at a high voltage, and displaying a video by using the backlight generated by the backlight module and via the liquid crystal display panel.

Since the display device and display method according to the present disclosure can use a waveform generator to generate a de-blur pulse signal and a compensation pulse signal, the operation of the control circuit and the driving circuit can be simplified, thereby reducing the abnormalities such as the false image brightness and/or image flickering caused by the delay of the control signal.

DETAILED DESCRIPTION

Figure 1:
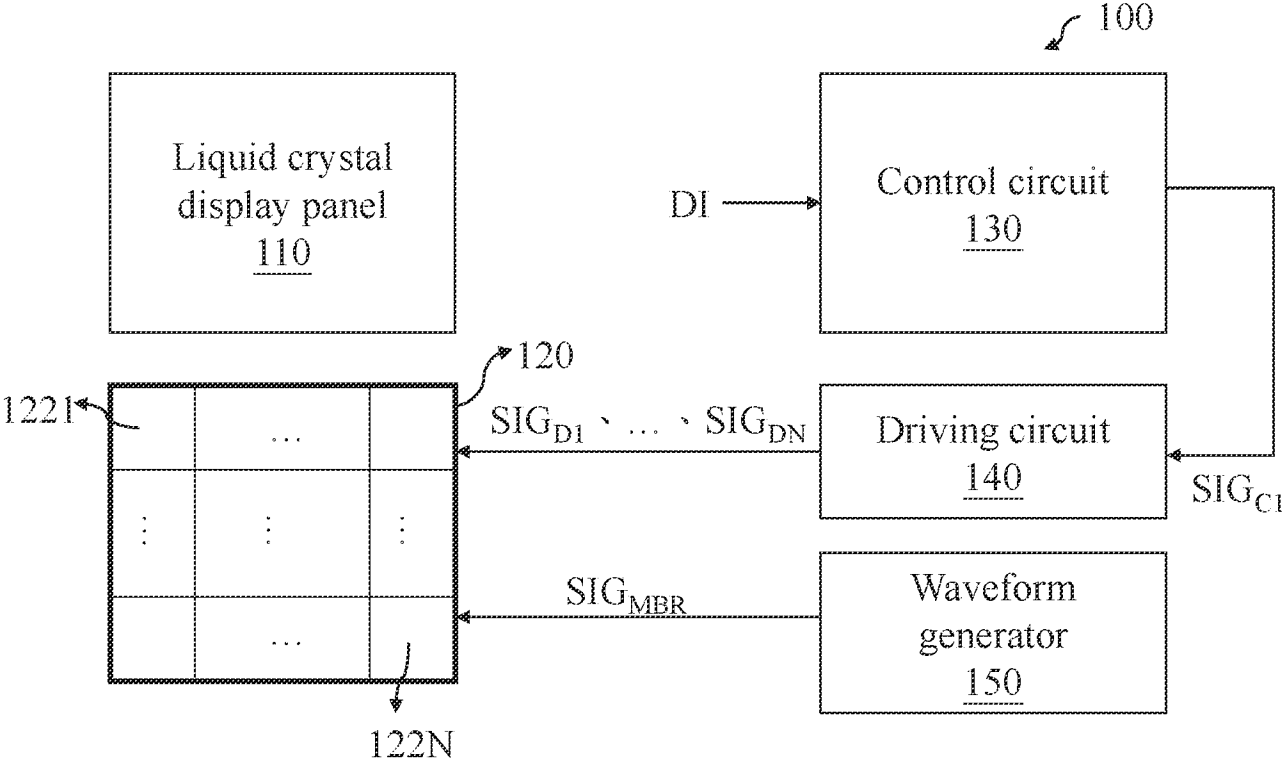
FIG. 1 is a schematic diagram illustrating a display device according to one embodiment of the present disclosure.

FIG. 1 is a schematic diagram illustrating a display device 100 according to one embodiment of the present disclosure. The display device 100 includes a liquid crystal display panel 110, a backlight module 120, a control circuit 130, a driving circuit 140 and, a waveform generator 150.

The liquid crystal display panel 110 includes a plurality of liquid crystal pixels, and the backlight module 120 can generate the backlight that the liquid crystal display panel 110 requires. In the present embodiment, the backlight module 120 can include a plurality of backlight blocks 1221 to 122N, and each of the backlight blocks 1221 to 122N can be controlled independently for local dimming. For example, when the brightness of the image content on the top left is higher and the brightness of the image content on the bottom right is lower, the display device 100 can make the backlight block 1221 on the top left emit backlight of higher brightness and the backlight block 122N on the bottom right emit backlight of lower brightness; that is, the backlight module 120 can make the backlight blocks 1221 to 122N respectively provide backlight of corresponding brightness according to the image content to be presented, so as to improve the contrast and/or reduce power consumption when rendering the image.

Figure 2:
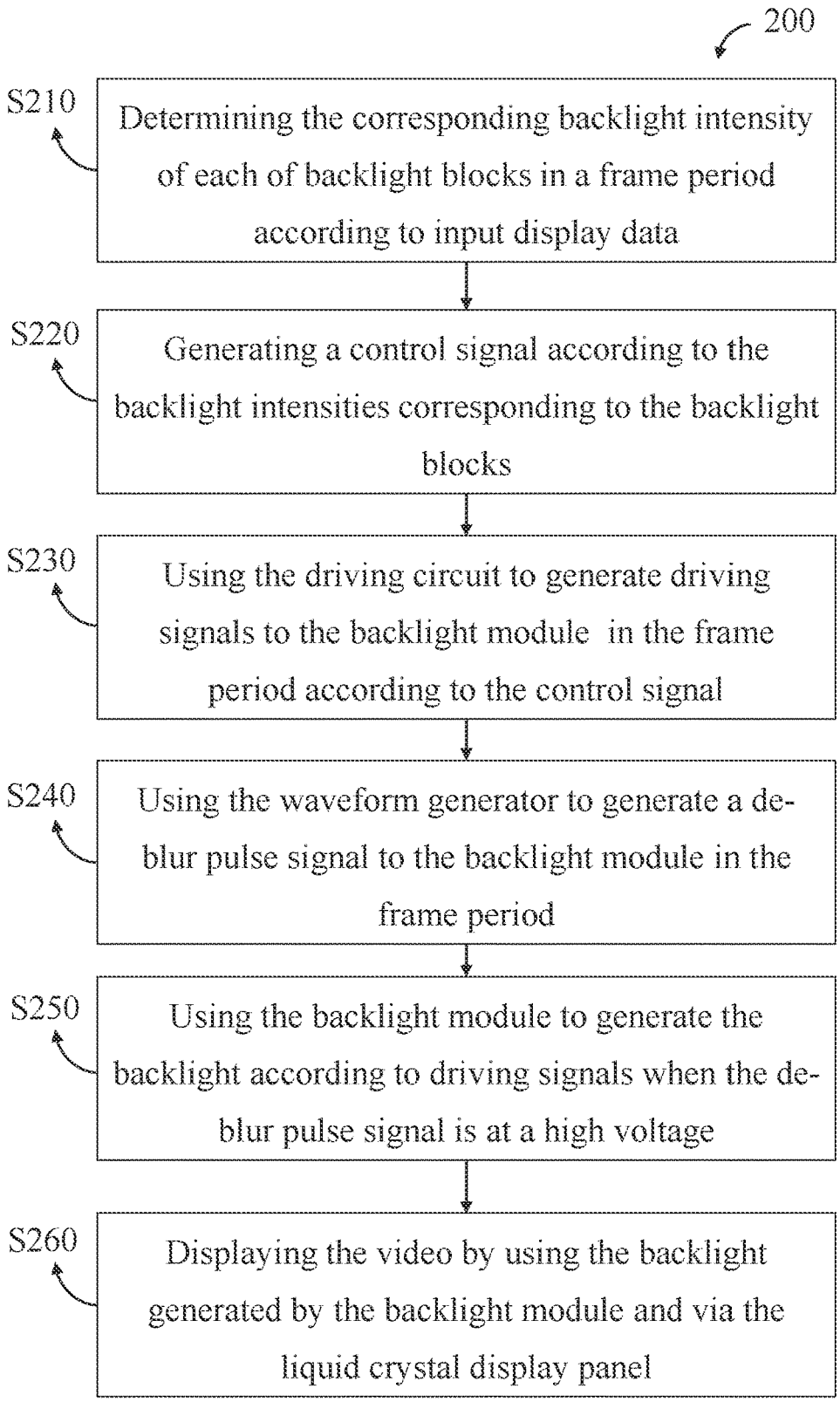
FIG. 2 is a flow chart of a method 200 for operating the display device in FIG. 1.

FIG. 2 is a flow chart of a method 200 for operating the display device 100. The method 200 includes Step S210 to S260.

S210: determining the corresponding backlight intensity of each of backlight blocks 1221 to 122N in a frame period FP1 according to input display data DI:

S220: generating a control signal $SIG_{C1}$ according to the backlight intensities corresponding to the backlight blocks 1221 to 122N;

S230: using the driving circuit 140 to generate driving signals $SIG_{D1}$ to $SIG_{DN}$ to the backlight module 120 in the frame period FP1 according to the control signal $SIG_{C1}$;

S240: using the waveform generator 150 to generate a de-blur pulse signal $SIG_{MBR}$ to the backlight module 120 in the frame period FP1;

S250: using the backlight module 120 to generate the backlight required by the liquid crystal display panel 110 according to driving signals $SIG_{D1}$ to $SIG_{DN}$ when the de-blur pulse signal $SIG_{MBR}$ is at a high voltage; and S260: displaying the video by using the backlight generated by the backlight module 120 and via the liquid crystal display panel 110.

In Step S210, the control circuit 130 can determine the backlight intensity that each of the backlight blocks 1221 to 122N corresponds to in each frame period according to an input display data DI. Then in Step S220, the control circuit 130 can generate the control signal $SIG_{C1}$ according to the backlight intensities of the backlight blocks 1221 to 122N. In the present embodiment, the control circuit 130 can include, such as a scaler.

Next in Step S230, the driving circuit 140 can generate a plurality of driving signals $SIG_{D1}$ to $SIG_{DN}$ to the backlight module 120 according to the control signal $SIG_{C1}$ in each frame period, so as to drive the backlight blocks 1221 to 122N of the backlight module 120 correspondingly, thereby achieving the technical effect of local dimming.

In the present embodiment, to reduce the issue of motion blur, the display device 100 would make the backlight module 120 provide the backlight in forms of strobe lights. That is, during each frame period, the backlight module 120 only emits lights in specified periods and does not emit light in periods other than the specified period. In this way, the human eye would not see the image displayed by the display device 100 consecutively, thereby reducing the motion blur issue resulted from the situation where the human eye sees the object's position in the image that is different from the expected position of the human brain.

However, the control circuit 130 and the driving circuit 140 are, in general, connected through a serial peripheral interface (SPI), whereas the control signal $SIG_{C1}$ is a signal in compliance with the SPI communication protocol. In such case, if the control circuit 130 also uses the SPI to transmit the control signal to the driving circuit 140 for driving the backlight blocks 1221 to 122N only in specified periods of the frame period, then the control circuit 130 needs to give multiple sets of commands consecutively in each frame time. Furthermore, since the timings of the strobe light and the driving signals for local dimming and motion blur reduction must be coordinated, the timing operation must be very precise. Otherwise, it may not produce the expected image or even lead to abnormal situations such as image flickering.

To simplify the timing operation to reduce the issues of image abnormalities, the display device 100 can use the waveform generator 150 to generate strobe pulse waves configured to reduce the motion blur. For example, in Step S240, the waveform generator 150 can generate a de-blur pulse signal $SIG_{MBR}$ to the backlight module 120 during each frame period, and in Step S250, the backlight blocks 1221 to 122N of the backlight module 120 would only emit lights according to the driving signals $SIG_{D1}$ to $SIG_{DN}$ when the de-blur pulse signal $SIG_{MBR}$ is at a high voltage. In this way, it is feasible to create the effect of strobe lights and reduce the undesired visual effect of motion blur.

Since the main purpose of the de-blur pulse signal $SIG_{MBR}$ is to drive the backlight blocks 1221 to 122N only in specified periods of the frame so as to insert non-emitting periods in each frame period, the waveform of the de-blur pulse signal $SIG_{MBR}$ may not be related to the content of the input display data DI, and hence, it is feasible to use the waveform generator 150 to generate pulse waves having a fixed length as the de-blur pulse signal $SIG_{MBR}$. In this way, the control circuit 130 does not have to give multiple sets of commands to the driving circuit 140 consecutively in each frame period, thereby simplifying the operation of the control circuit 130 and the driving circuit 140. In some embodiments, the waveform generator 150 can be implemented by using, for example, a timing controller (TCON) of the system.

Figure 3:
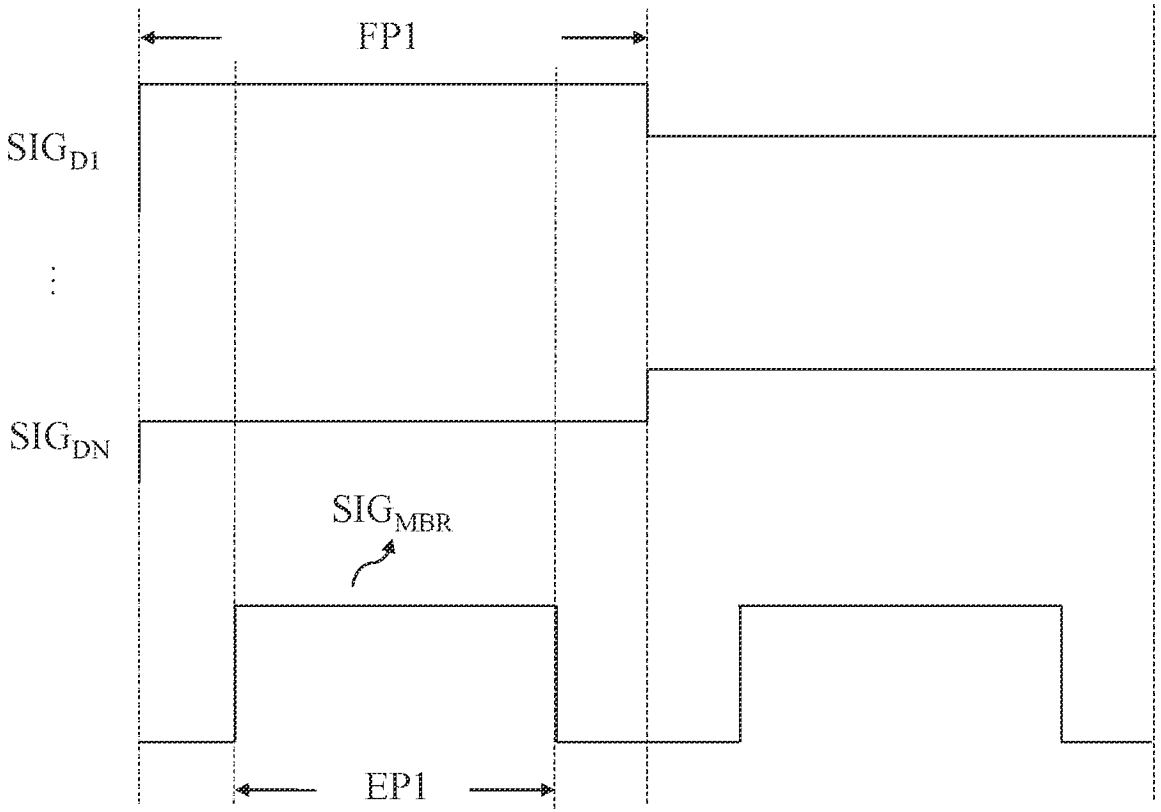
FIG. 3 is a timing diagram of signals generated by the display device in FIG. 1 during a frame period.

FIG. 3 is a timing diagram of signals generated by the display device 100 during the frame period FP1. In FIG. 3, the de-blurring pulse signal $SIG_{MBR}$ can be a pulse wave having a single pulse. However, in some other embodiments, the de-blurring pulse signal $SIG_{MBR}$ may include multiple pulse waves. Furthermore, in FIG. 3, the driving circuit 140 can drive the backlight module 120 in an analog manner. In such case, the driving signals $SIG_{D1}$ to $SIG_{DN}$ can be, for example, current signals. That is, the driving circuit 140 will provide driving signals $SIG_{D1}$ to $SIG_{DN}$ with corresponding current intensities to the backlight blocks 1221 to 122N according to the instructions of the control signal $SIG_{C1}$, so that the backlight blocks 1221 to 122N can emit light having corresponding brightness. As a result, when the current of the driving signal $SIG_{D1}$ is greater, the backlight block 1221 will correspondingly emit light with greater brightness. However, in some other embodiments, the driving circuit 140 can also drive the backlight module 120 in a digital manner. In such case, the driving signals $SIG_{D1}$ to $SIG_{DN}$ can be pulse-width modulation signals with a fixed current intensity. That is, the driving circuit 140 can generate the driving signals $SIG_{D1}$ to $SIG_{DN}$ having a specific frequency and a corresponding duty cycle to the backlight blocks 1221 to 122N according to the control signal $SIG_{C1}$ so that the backlight blocks 1221 to 122N can emit lights having corresponding brightness. In such case, when the duty cycle of the driving signal $SIG_{D1}$ is closer to 100%, the backlight block 1221 will correspondingly emit light having a greater intensity.

Moreover, in FIG. 3, the driving circuit 140 can output driving signals $SIG_{D1}$ to $SIG_{DN}$ continuously; however, the backlight module 120 can use a logic circuit, such as an AND gate, to perform logic computation on the driving signals $SIG_{D1}$ to $SIG_{DN}$ and the de-blur pulse signal $SIG_{MBR}$, so that the backlight blocks 1221 to 122N will only emit lights having corresponding intensities according to driving signals $SIG_{D1}$ to $SIG_{DN}$ in an emitting period EP1 when the de-blur pulse signal $SIG_{MBR}$ is at a high voltage.

In some embodiments, the method 200 can further dynamically adjust a refresh rate at which the display device 100 refreshes the image, such as increasing the refresh rate for refreshing the image (e.g., from 60 Hz to 120 Hz), to improve the video displaying quality, or to decrease the refresh rate for refreshing the image to reduce the power consumption. In such cases, when the refresh rate changes, the length of the frame period changes correspondingly. Therefore, the waveform generator 150 can also adjust the number of the pulses included in the de-blur pulse signal $SIG_{MBR}$ and the duration of each pulse in the high voltage according to the refresh rate of the display device 100.

Furthermore, when the refresh rate of the display device 100 is adjusted dynamically, if the waveform generator 150 does not adjust the waveform of the de-blur pulse signal $SIG_{MBR}$ correspondingly, the intensity of the image displayed may not meet the user's expectation. In such case, the waveform generator 150 can also generate a compensation pulse signal $SIG_{CS}$ to the backlight module 120 in the frame period FP1 after the de-blur pulse signal $SIG_{MBR}$ is generated, and the backlight blocks 1221 to 122N can also emit lights according to driving signals $SIG_{D1}$ to $SIG_{DN}$ when the compensation pulse signal $SIG_{CS}$ is at a high voltage.

Figure 4:
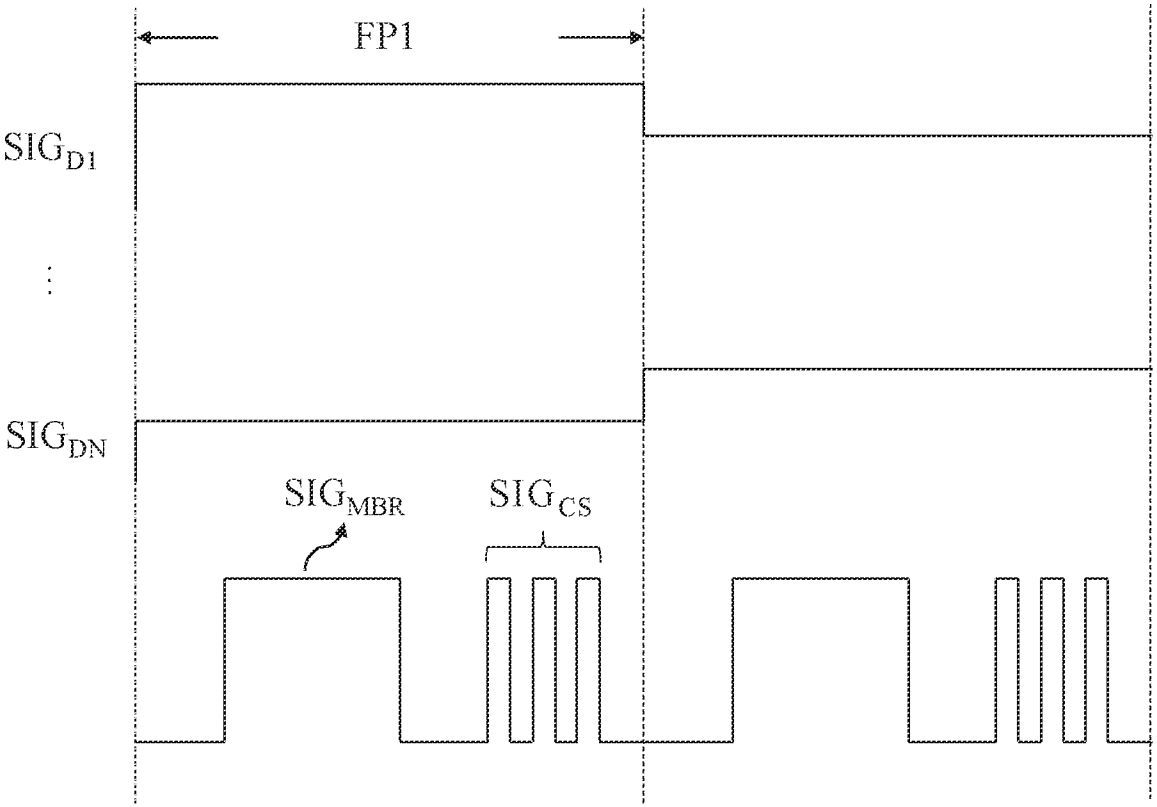
FIG. 4 is another timing diagram of signals generated by the display device during a frame period.

FIG. 4 is another timing diagram of signals generated by the display device 100 during the frame period FP1. For example, when the refresh rate decreases, the length of the frame period FP1 would increases; in such case, if the duration that the de-blur pulse signal $SIG_{MBR}$ is at the high voltage is not extended correspondingly, the ratio of time that the backlight blocks 1221 to 122N actually emit light would decrease, thereby causing the overall brightness displayed by the display device 100 to decrease. In such case, the waveform generator 150 can generate the compensation pulse signal $SIG_{CS}$ after the de-blur pulse signal $SIG_{MBR}$ is generated so as to increase the time that the backlight blocks 1221 to 122N emit light during the frame period FP1, thereby compensating the overall brightness. In FIG. 4, the compensation pulse signal $SIG_{CS}$ may include at least one pulse.

Since the display device 100 can use the waveform generator 150 to generate the compensation pulse signal $SIG_{CS}$, the control circuit 130 does not need to further transmit other control signals to the driving circuit 140 through the SPI, thereby simplifying the operation of the control circuit 130 and the driving circuit 140 and reducing the abnormalities such as the unexpected image brightness and/or image flickering caused by the delay of the control signal.

Moreover, in some embodiments, the de-blur pulse signal $SIG_{MBR}$ generated by the waveform generator 150 may have a fixed length, and when the refresh rate changes, the waveform generator 150 only needs to adjust the number of the pulses included in the compensation pulse signal $SIG_{CS}$, so as to ensure that the backlight module 120 can provide the desired backlight intensity during each frame period. In this way, there is no need to further adjust the waveform de-blur pulse signal $SIG_{MBR}$, thereby simplifying the operation of the waveform generator 150.

In summary, the display device and display method according to the present disclosure can use a waveform generator to generate a de-blur pulse signal and a compensation pulse signal, thereby simplifying the operation of the control circuit and the driving circuit so as to reduce the abnormalities such as the false image brightness and/or image flickering caused by the delay of the control signal.

What is claimed is:

1. A display device, comprising:

a liquid crystal display panel, comprising a plurality of liquid crystal pixels;

a backlight module, configured to generate backlight required by the liquid crystal display panel, wherein the backlight module comprises a plurality of backlight blocks;

a control circuit, configured to determine a backlight intensity corresponding to each backlight block of the plurality of backlight blocks in a frame period according to an input display data, and generate a control signal according to a plurality of backlight intensities corresponding to the plurality of backlight blocks;

a driving circuit, configured to generate a plurality of driving signals to the backlight module in the frame period according to the control signal; and a waveform generator, configured to generate a de-blur pulse signal having a fixed length to the backlight module in the frame period;

wherein the plurality of backlight blocks in the backlight module emit lights according to the plurality of driving signals when the de-blur pulse signal is at a high voltage;

wherein the control signal and the de-blur pulse signal are generated by different circuits; and wherein the waveform generator does not receive signals from the control circuit while generating the de-blur pulse signal.

2. The display device of claim 1, wherein at least two backlight blocks of the plurality of backlight blocks correspond to different backlight intensities.

3. The display device of claim 1, wherein when a refresh rate of the display device is dynamically adjusted, the waveform generator is further configured to generate a compensation pulse signal to the backlight module in the frame period after generating the de-blur pulse signal, wherein the plurality of backlight blocks are further configured to emit lights according to the plurality of driving signals when the compensation pulse signal is at the high voltage.

4. The display device of claim 3, wherein the compensation pulse signal comprises at least one pulse.

5. The display device of claim 1, wherein the plurality of driving signals are current signals, and the plurality of backlight blocks emit lights having corresponding intensities according to current intensities of the plurality of driving signals when the de-blur pulse signal is at the high voltage.

6. The display device of claim 1, wherein the plurality of driving signals are pulse-width modulation signals, and the plurality of backlight blocks emit lights having corresponding intensities according to duty cycles of the plurality of driving signals when the de-blur pulse signal is at the high voltage.

7. The display device of claim 1, wherein the waveform generator is a timing controller.

8. The display device of claim 1, wherein the control circuit comprises a scaler.

9. The display device of claim 1, wherein the control signal is a signal that conforms to the communication standard of the serial peripheral interface (SPI).

10. The display device of claim 1, wherein the waveform generator is further configured to adjust a number of pulses included in the de-blur pulse signal and a duration of each pulse at the high voltage according to a refresh rate of the display device.

11. A display method, comprising:

determining a backlight intensity corresponding to each backlight block of a plurality of backlight blocks of a backlight module in a frame period according to an input display data;

generating a control signal according to a plurality of backlight intensities corresponding to the plurality of backlight blocks;

using a driving circuit to generate a plurality of driving signals to the backlight module in the frame period according to the control signal;

using a waveform generator to generate a de-blur pulse signal having a fixed length to the backlight module in the frame period;

using the backlight module to generate a backlight required by a liquid crystal display panel according to the plurality of driving signals when the de-blur pulse signal is at a high voltage; and displaying a video by using the backlight generated by the backlight module and via the liquid crystal display panel;

wherein the control signal and the de-blur pulse signal are generated by different circuits; and wherein the waveform generator does not receive signals from the control circuit while generating the de-blur pulse signal.

12. The method of claim 11, wherein at least two backlight blocks of the plurality of backlight blocks correspond to different backlight intensities.

13. The method of claim 11, further comprising:

dynamically adjusting a refresh rate for displaying the video.

14. The method of claim 13, further comprising:

using the waveform generator to generate a compensation pulse signal to the backlight module in the frame period after generating the de-blur pulse signal; and using the plurality of backlight blocks to generate lights having corresponding intensities according to the plurality of driving signals when the compensation pulse signal is at a high voltage.

15. The method of claim 14, wherein the compensation pulse signal comprises at least one pulse.

16. The method of claim 13, further comprising using the waveform generator to adjust a number of pulses included in the de-blur pulse signal and a duration of each pulse at the high voltage according to the refresh rate.

17. The method of claim 11, wherein the plurality of driving signals are current signals, and the step of using the backlight module to generate the backlight required by the liquid crystal display panel according to the plurality of driving signals when the de-blur pulse signal is at the high voltage comprises using the plurality of backlight blocks to emit lights having corresponding intensities according to current intensities of the plurality of driving signals when the de-blur pulse signal is at the high voltage.

18. The method of claim 11, wherein the plurality of driving signals are pulse-width modulation signals, and the step of using the backlight module to generate the backlight required by the liquid crystal display panel according to the plurality of driving signals when the de-blur pulse signal is at the high voltage comprises using the plurality of backlight blocks to emit lights having corresponding intensities according to duty cycles of the plurality of driving signals when the de-blur pulse signal is at the high voltage.

19. The method of claim 11, wherein the waveform generator is a timing controller.

20. The method of claim 11, wherein the control signal is a signal that conforms to the communication standard of the serial peripheral interface (SPI).

* * * * *